US008095024B2

(12) United States Patent
Yamaki

(10) Patent No.: US 8,095,024 B2
(45) Date of Patent: Jan. 10, 2012

(54) IMAGE FORMING DEVICE AND IMAGE FORMING METHOD DETECTING A REFERENCE POINT ON AN INTERMEDIATE TRANSFER MEMBER

(75) Inventor: Hideo Yamaki, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 449 days.

(21) Appl. No.: 11/802,845

(22) Filed: May 25, 2007

(65) Prior Publication Data

US 2007/0292172 A1 Dec. 20, 2007

(30) Foreign Application Priority Data

Jun. 19, 2006 (JP) ..... 2006-169067

(51) Int. Cl.
*G03G 15/00* (2006.01)

(52) U.S. Cl. ..... 399/38; 399/301; 399/302

(58) Field of Classification Search ..... 399/38, 399/49, 301, 302, 394
See application file for complete search history.

(56) References Cited

U.S. PATENT DOCUMENTS 5,499,092 A 3/1996 Sasaki

FOREIGN PATENT DOCUMENTS

| | | | |
|---|---|---|---|
| JP | 8-123291 | A | 5/1996 |
| JP | 10-115966 | | 5/1998 |
| JP | 2001-075370 | | 3/2001 |
| JP | 2002-006645 | A | 1/2002 |
| JP | 2003-195604 | A | 7/2003 |
| JP | 2004-037491 | A | 2/2004 |

OTHER PUBLICATIONS

Japanese Office Action mailed Apr. 8, 2008, directed to counterpart JP application No. 2006-169067; 10 pages.

*Primary Examiner* — Hoang Ngo
(74) *Attorney, Agent, or Firm* — Morrison & Foerster LLP

(57) ABSTRACT

An image forming device that transfers a plurality of toner images of different colors in layers, onto an intermediate transfer member by controlling a timing of forming each of the plurality of toner images, based on a reference position on a surface of the intermediate transfer member, the image forming device comprising: an uneven part detecting unit operable to detect at least one uneven part that is any of a depression and a projection, on the surface of the intermediate transfer member; and a reference uneven part setting unit operable to set a reference uneven part that defines the reference position, from among the at least one uneven part detected by the uneven part detecting unit.

24 Claims, 14 Drawing Sheets

| UNEVEN PART NUMBER X | BELT POSITION Y | DETECTION OUTPUT Z | UNEVEN PART RANK |
|---|---|---|---|
| 1 | 180 | 0.5 | 3 |
| 2 | 220 | 1.0 | 2 |
| 3 | 380 | 2.0 | 1 |

IMAGE FORMING DEVICE AND IMAGE FORMING METHOD DETECTING A REFERENCE POINT ON AN INTERMEDIATE TRANSFER MEMBER

CROSS REFERENCE TO RELATED APPLICATIONS

This application is based on application NO. 2006-169067 filed in Japan, the contents of which are hereby incorporated by reference.

BACKGROUND OF THE INVENTION (1) Field of the Invention

The present invention relates to an image forming device and an image forming method, and especially to a technology for preventing a positional shift of toner images of different colors that are transferred in layers onto an intermediate transfer member such as an intermediate transfer belt.

(2) Description of the Related Art

A 4-cycle color printer uses a technology of transferring toner images of yellow (Y), magenta (M), cyan (C), and black (K) in layers onto an intermediate transfer belt via one photoreceptor. In the 4-cycle color printer, in general, the toner images of different colors are formed on the photoreceptor at a timing based on a reference belt position of the intermediate transfer belt, and the formed toner images are transferred onto the intermediate transfer belt in layers. Therefore, the toner images of different colors have less incidence of the positional shift.

The reference belt position is recognized, for example, by detecting a hole provided in an intermediate transfer belt by a light transmission type sensor, or by detecting reflecting tape provided in an intermediate transfer belt by a reflection-type sensor. Also, U.S. Pat. No. 5,499,092 discloses an image forming device that forms a toner patch for detecting a reference belt position on an intermediate transfer belt so that a reflection-type sensor can detect the toner patch to recognize the reference belt position.

However, in order to provide a hole or reflecting tape in an intermediate transfer belt, a space for the hole or the reflecting tape needs to be secured in an area other than a toner image forming area and a contact area of a cleaner. This raises a need to increase the intermediate transfer belt in width and thus raises a need to increase the image forming device in size.

On the other hand, a toner patch can be formed in a toner image forming area and a contact area of a cleaner. This construction prevents an intermediate transfer belt from becoming wider and an image forming device from enlarging because there is no need to increase the intermediate transfer belt in width. However, running cost becomes higher because toner is consumed to form the toner patch.

SUMMARY OF THE INVENTION

An object of the present invention is therefore to provide an image forming device that does not increase in size and is operational with low cost, and an image forming method for the image forming device.

The above object is fulfilled by an image forming device that transfers a plurality of toner images of different colors in layers, onto an intermediate transfer member by controlling a timing of forming each of the plurality of toner images, based on a reference position on a surface of the intermediate transfer member, the image forming device comprising: an uneven part detecting unit operable to detect at least one uneven part that is any of a depression and a projection, on the surface of the intermediate transfer member; and a reference uneven part setting unit operable to set a reference uneven part that defines the reference position, from among the at least one uneven part detected by the uneven part detecting unit.

The above object is also fulfilled by an image forming device for forming a color image, comprising: an intermediate transfer member, being rotated, onto which toner images of different colors are transferred one by one based on a reference position thereon; an uneven part detecting unit that is arranged to face the intermediate transfer member, and detects at least one uneven part that is any of a depression and a projection, on a surface of the intermediate transfer member; and a specifying unit operable to specify a location of the intermediate transfer member as the reference position based on a result of detecting the at least one uneven part by the uneven part detecting unit.

The above object is fulfilled by an image forming method that transfers a plurality of toner images of different colors in layers, onto an intermediate transfer member by controlling a timing of forming each of the plurality of toner images, based on a reference position on a surface of the intermediate transfer member, the image forming method comprising the steps of: detecting at least one uneven part that is any of a depression and a projection, on the surface of the intermediate transfer member; and setting a reference uneven part that defines the reference position, from among the at least one uneven part detected in the uneven part detecting step.

With the above-stated construction, there is no need to secure a space for providing a hole or reflecting tape on an intermediate transfer member. This prevents the intermediate transfer member from increasing in size and prevents an image forming device from increasing in size. Also, there is no need to form a toner patch on an intermediate transfer member. This prevents running cost of consuming toner from becoming higher. That is to say, in the present invention, one of uneven parts, which is originally included on a surface of an intermediate transfer member, is used as a reference uneven part and a reference position is recognized by the reference uneven part. Therefore, there is no need to provide a mark indicating the reference position on the intermediate transfer member.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes an embodiment of an image forming device and an image forming method of the present invention, with reference to the attached drawings.

<Construction of Image Forming Device>

Figure 1:
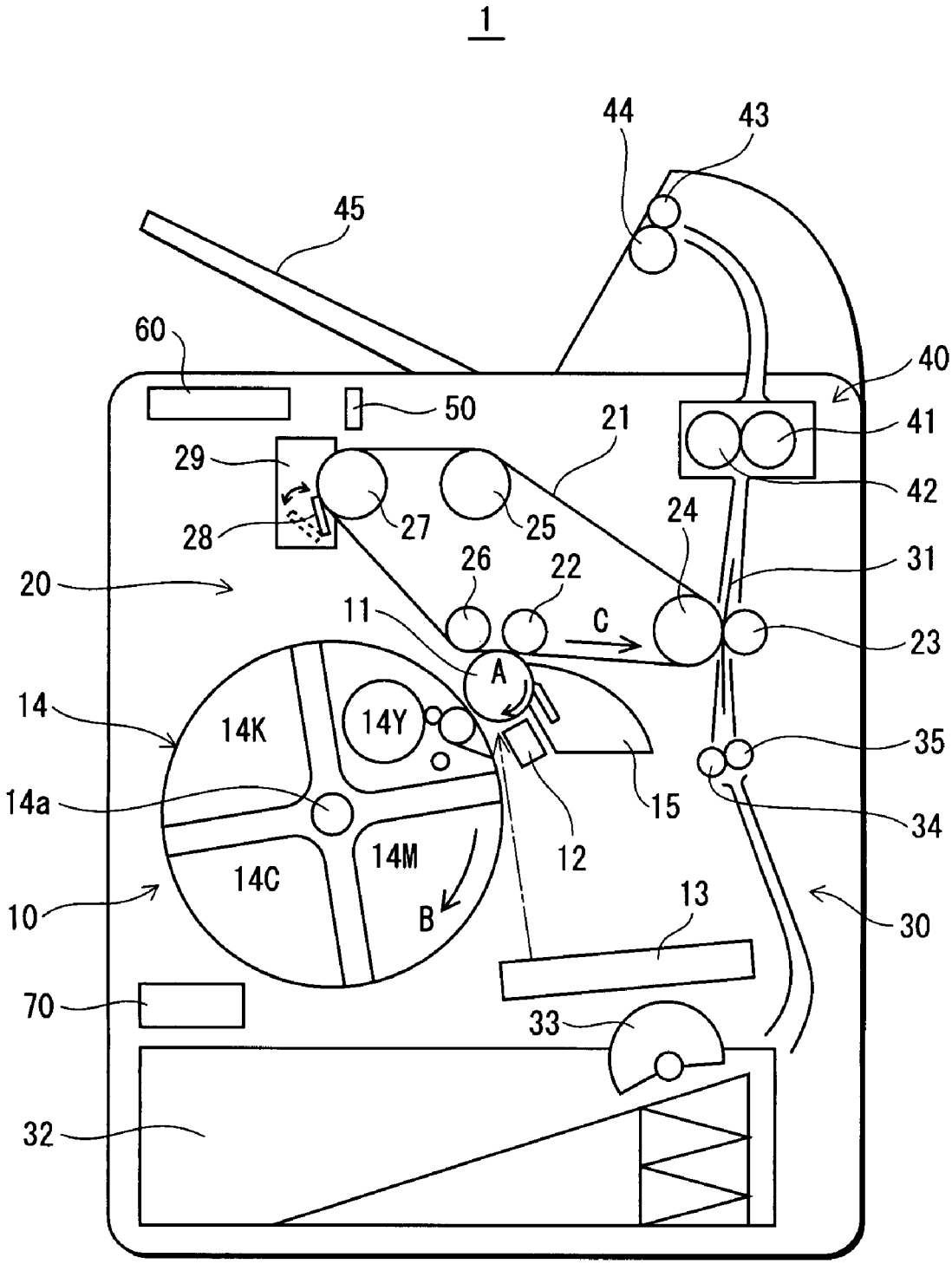
FIG. 1 shows an overall construction of a printer of an embodiment.

FIG. 1 shows an overall construction of an image forming device of the embodiment. As shown in FIG. 1, the image forming device of the embodiment is a 4-cycle color printer 1 (hereinafter, merely referred to as "printer 1") that includes one photoreceptor on which toner images of different colors of yellow (Y), magenta (M), cyan (C), and black (K) are formed, the toner images of different colors are formed in sequence on a surface of the photoreceptor, and the formed toner images of different colors are transferred in sequence in layers onto an intermediate transfer member.

The printer 1 includes an image forming unit 10, an intermediate transferring unit 20, a paper feeding unit 30, a fixing unit 40, an uneven part detecting unit 50, a displaying unit 60, and a control unit 70 and the like. The printer 1 performs a color printing using the different colors of yellow (Y), magenta (M), cyan (C), and black (K), or a monochrome printing using the color of black (K), upon receiving an instruction from an external terminal apparatus (not illustrated) connected thereto via a network such as a LAN.

The image forming unit 10 includes a photosensitive drum 11 as the photoreceptor, a charging apparatus 12, an exposing apparatus 13, a developing apparatus 14, and a cleaning apparatus 15 that are arranged around the photosensitive drum 11.

The photosensitive drum 11 is in a shape of a cylinder on whose surface a photosensitive layer (not illustrated) is formed, and rotates in a direction indicated by an arrow A in FIG. 1.

The charging apparatus 12 operates to make the surface of the photosensitive drum 11 uniformly charged at a certain potential.

The exposing apparatus 13 forms an electrostatic latent image on the surface of the photosensitive drum 11 by radiating a laser beam, which corresponds to a time-series electric digital pixel signal of image information, onto the surface of the photosensitive drum 11 to change a charging potential of a portion to be exposed.

The developing apparatus 14, including developers 14Y, 14M, 14C, and 14K that correspond respectively to the colors Y, M, C, and K, drives itself to rotate around a rotation axis 14*a* in a direction indicated by a narrow B in FIG. 1. The developing apparatus 14 develops the electrostatic latent image on the surface of the photosensitive drum 11 in sequence using toners of colors respectively filled in the developers 14Y, 14M, 14C, and 14K.

The cleaning apparatus 15 removes remnant toners remaining on the surface of the photosensitive drum 11 after transferring.

The intermediate transferring unit 20 includes an intermediate transfer belt 21 as an intermediate transfer member, an initial transfer roller 22, a secondary transfer roller 23, a secondary transfer opposing roller 24, tension rollers 25 and 26, a cleaner opposing roller 27, and a cleaner 29 that includes a cleaner blade 28 as a cleaning member that is detachably contactable with a surface of the intermediate transfer belt 21.

The intermediate transfer belt 21 is in a shape of an endless belt, and is made of a semiconductor resin formed by adding a conductive material to polycarbonate, polyimide, polyphenylene sulfide, fluorocarbon resin and the like. The intermediate transfer belt 21 is suspended with tension between the initial transfer roller 22, the secondary transfer opposing roller 24, the tension rollers 25 and 26, and the cleaner opposing roller 27, and circles in a direction indicated by an arrow C in FIG. 1 as a driving unit (not illustrated) drives the secondary transfer opposing roller 24 to rotate.

The initial transfer roller 22 is arranged to face the photosensitive drum 11 with the intermediate transfer belt 21 in between such that an initial transfer position is located between the initial transfer roller 22 and the photosensitive drum 11. Also, the secondary transfer roller 23 and the secondary transfer opposing roller 24 are arranged to face each other with the intermediate transfer belt 21 in between such that a secondary transfer position is located between the secondary transfer roller 23 and the secondary transfer opposing roller 24.

The cleaner 29 has the cleaner blade 28 contact with the surface of the intermediate transfer belt 21 to collect and remove unnecessary toners from the surface. The unnecessary toners are such as remnant toners caused by a transfer failure, toner dust sticking to the surface, toners caused by toner fogging and the like. The collected toners are stored in the cleaner 29. The cleaner blade 28 is arranged to be away from the surface of the intermediate transfer belt 21 as a reference position, and is contacted with the surface of the intermediate transfer belt 21 when removing toners.

The paper feeding unit 30 includes a paper feed cassette 32 for storing a sheet 31 as a transfer material, a pickup roller 33 for picking up the sheet 31 from the paper feed cassette 32, and a pair of resist rollers 34 and 35 for transporting the picked up sheet 31 to the secondary transfer position. The sheet 31 is transported to the secondary transfer position at a timing when the secondary transfer is performed.

The fixing unit 40 includes a pair of fixing rollers 41 and 42 that are arranged to face each other, and rotate while being in contact with each other. Each of the fixing rollers 41 and 42 is provided with an internal heater (not illustrated) such that when the sheet 31 passes between the fixing rollers 41 and 42, the sheet 31 is pressed at a high temperature. This enables toners, which form a toner image on the sheet 31, to be fusion-bonded with the sheet 31 and fixed thereto. The sheet 31 to which the toners have been fixed is ejected into an outlet tray 45 by eject rollers 43 and 44.

An AIDC (Auto Image Density Control) sensor for image control is also used as the uneven part detecting unit 50. According to this construction, there is no need to provide separately the uneven part detecting unit 50, and this makes it possible to achieve a device with low cost and a simple construction.

The uneven part detecting unit 50 includes a reflection-type sensor, as a light volume detecting unit, for detecting an uneven part on the surface of the intermediate transfer belt 21. The reflection-type sensor has a light emitting element for emitting light to an intermediate transfer member and a light receiving element for receiving the light reflected on a surface of the intermediate transfer member.

Here, an uneven part is the following part. Assuming that the surface of the intermediate transfer belt 21 is completely even and smooth, the surface often has a part whose surface does not correspond to the assumed surface. This part is the uneven part and has a concave portion and a convex portion. The concave portion is depressed portion such as a weld, a scratch, a dent, or a line. The convex portion is raised portion such as a weld, a bump, or a line.

Note that a weld means a link of the intermediate transfer belt 21. In most cases, the intermediate transfer belt 21 in general has a weld to a varying degree of a size.

When producing the intermediate transfer belt 21 at low cost, it is preferable to employ an injection molding process. Moreover, it is preferable to omit a heat treatment process that is performed after the injection molding process. However, the weld easily occurs on the intermediate transfer belt 21 especially when this method is employed.

The displaying unit 60 displays a message to users. The users can confirm job information and management information via the displaying unit 60. For example, when an integrated detection output of uneven parts detected for one rotation of the intermediate transfer belt 21 is equal to or larger than a predetermined value, or when the image area includes an uneven part having a detection output that is equal to or larger than a predetermined value, the displaying unit 60 displays a predetermined message such as "It is impossible to form an image". In this way, the users can notice that there is a problem of forming the image because of the bad surface state of the intermediate transfer belt 21. Moreover, the displaying unit 60 responds to various operations of the printer 1, so the users can change various settings and the like.

Figure 2:
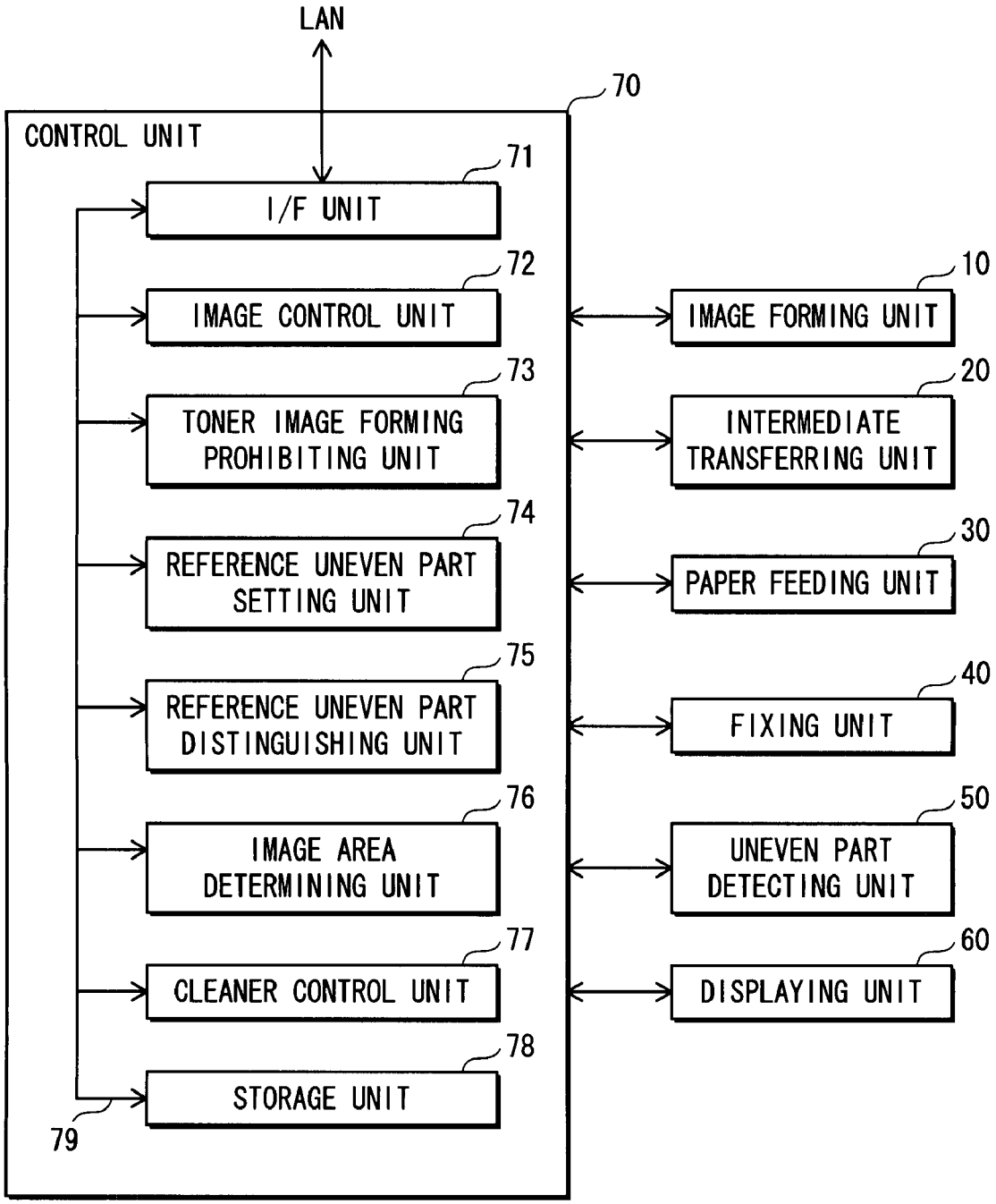
FIG. 2 is a block diagram showing a construction of a control unit.

FIG. 2 is a block diagram showing a construction of the control unit.

As shown in FIG. 2, the control unit 70 includes, as major constituent elements, a communication interface (I/F) unit 71, an image control unit 72, a toner image forming prohibiting unit 73, a reference uneven part setting unit 74, a reference uneven part distinguishing unit 75, an image area determining unit 76, a cleaner control unit 77, and a storage unit 78. These units 71 to 78 can communicate with each other via a bus 79.

The communication interface (I/F) unit 71 is an interface achieved in a LAN card, a LAN board or the like and is used to connect with a LAN.

The image control unit 72 controls an overall operation of the image forming unit 10, the intermediate transferring unit 20 and the like to realize a smooth printing operation. When toner images of different colors are transferred in layers onto the intermediate transfer member 21, the image control unit 72 controls a timing, at which the toner images are formed on the intermediate transfer belt 21, based on a reference belt position on the surface of the intermediate transfer belt 21 (note that if an intermediate transfer member is not in a shape of a belt, merely referred to as "reference position").

The toner image forming prohibiting unit 73 prohibits forming toner images of different colors on the intermediate transfer belt 21 when an integrated detection output of uneven parts detected for one rotation of the intermediate transfer belt 21 is equal to or larger than a predetermined value. With this construction, the toner images are not formed on the intermediate transfer belt 21 with a large number of uneven parts thereon and a bad surface state thereof. As a result, a low quality image is not formed. Also, the toner image forming prohibiting unit 73 prohibits forming toner images of different colors on the intermediate transfer belt 21 when the image area includes an uneven part having a detection output that is equal to or larger than a predetermined value. This construction reduces the possibility that a low quality image is formed because the toner images are not formed in an area that includes an uneven part having a large detection output. This will be described in details later.

The reference uneven part setting unit 74 sets an uneven part having a largest detection output among uneven parts detected by the uneven part detecting unit 50, as a reference uneven part that defines a reference belt position on the surface of the intermediate transfer belt. This would make it easier to set a reference uneven part, and a distinguishing accuracy of the reference uneven part is improved.

Furthermore, each time the uneven part detecting unit 50 performs the detection on the surface of the intermediate transfer member, the reference uneven part setting unit 74 resets the reference uneven part to an uneven part having a largest detection output among uneven parts newly detected by the uneven part detecting unit 50 as a new reference uneven part, and replaces the detection output stored in the storage unit 78 by the detection output of the new reference uneven part. This would easily maintain a state in which an uneven part having a largest detection output is set as a reference uneven part. Also, it is possible to form a toner image in better condition because the toner image can be formed by avoiding a new reference uneven part having a larger detection output than that of a previous reference uneven part. This will be described in details later.

After setting a reference uneven part, the reference uneven part distinguishing unit 75 distinguishes an uneven part corresponding to the reference uneven part among uneven parts newly detected by the uneven part detecting unit 50, and specifies a reference belt position. In other words, the reference uneven part distinguishing unit 75, as a specifying unit, specifies a location of the intermediate transfer belt 21 as a reference belt position based on a result of detecting uneven parts by the uneven part detecting unit 50. This will be described in details later.

The image area determining unit 76 determines a suitable location of an image area for forming a toner image on the surface of the intermediate transfer belt 21 based on a result of detecting uneven parts by the uneven part detecting unit 50. With this construction, a high quality image can be formed because it is possible to secure an area for forming the toner image by avoiding the uneven parts. This will be described in details later. Hereinafter, an area excluding an image area is referred to as a non-image area.

The cleaner control unit 77 controls the cleaner 29. More specifically, the cleaner control unit 77 controls the cleaner 29 so that the cleaner blade 28 contacts with an image area and does not contact a non-image area except for a predetermined case. This construction reduces the possibility that the cleaner 29 is damaged because the cleaner 29 is not easily contacted with an area that includes uneven parts. Note that the predetermined case is that a detection accuracy of the uneven part detecting unit 50 degrades, for example.

The storage unit 78 stores a data table which stores uneven part information such as an uneven part number X, a belt position Y, a detection output Z, an uneven part rank and the like. The uneven part information and the data table will be described in details later. Moreover, the storage unit 78 calculates the total number of prints Dt based on the number of prints D that is counted per print job. The storage unit 78 stores the calculated total number of prints Dt as print number information.

<Operation of Image Forming Device>

1. Image Process

Upon receiving an image signal for a print job from an external terminal device (not illustrated), the control unit 70 generates image data by performing necessary processes on the received image signal, and converts the image data into a drive signal for driving the exposing apparatus 13. Upon receiving the drive signal from the control unit 70, the exposing apparatus 13 radiates a laser beam for forming an image onto the surface of the photosensitive drum 11 to perform exposure scanning thereof. When this exposure-scanning is performed, the surface of the photosensitive drum 11 is cleaned by the cleaning apparatus 15, the electricity is removed from the surface by an eraser lamp (not illustrated), and the surface is uniformly charged by the charging apparatus 12.

The electrostatic latent image on the surface of the photosensitive drum 11 is developed into a toner image of a color by one of the developers 14Y, 14M, 14C, and 14K. When the electrostatic latent image is developed into toner images of all colors of the developers 14Y, 14M, 14C, and 14K, the toner images are layered on the intermediate transfer belt 21 at the initial transfer position so that a color image is reproduced. The control unit 70 controls a timing at which the toner images of different colors are formed on the photosensitive drum 11 based on a reference belt position that is defined by a reference uneven part. Therefore, the toner images of different colors are transferred onto the intermediate transfer belt 21 in layers without a positional shift.

On the other hand, the sheet 31 is transported from the paper feed cassette 32 to the secondary transfer position. At the secondary transfer position, the toner image is transferred from the intermediate transfer belt 21 onto the surface of the sheet 31 by the electrostatic action of the secondary transfer roller 23. The sheet 31 on which the toner image has been transferred is transported from the secondary transfer position to the fixing unit 40, where the toner image is fixed onto the sheet 31 by the fixing rollers 41 and 42, and then the sheet 31 is ejected into the outlet tray 45.

2. Reference Uneven Part Setting Process

As mentioned above, a timing at which toner images of different colors are formed is controlled based on a reference belt position that is defined by a reference uneven part. The reference uneven part is set by a reference uneven part setting process by the reference uneven part setting unit 74. The reference uneven part setting process is performed on a first start-up of the printer 1.

Figure 3:
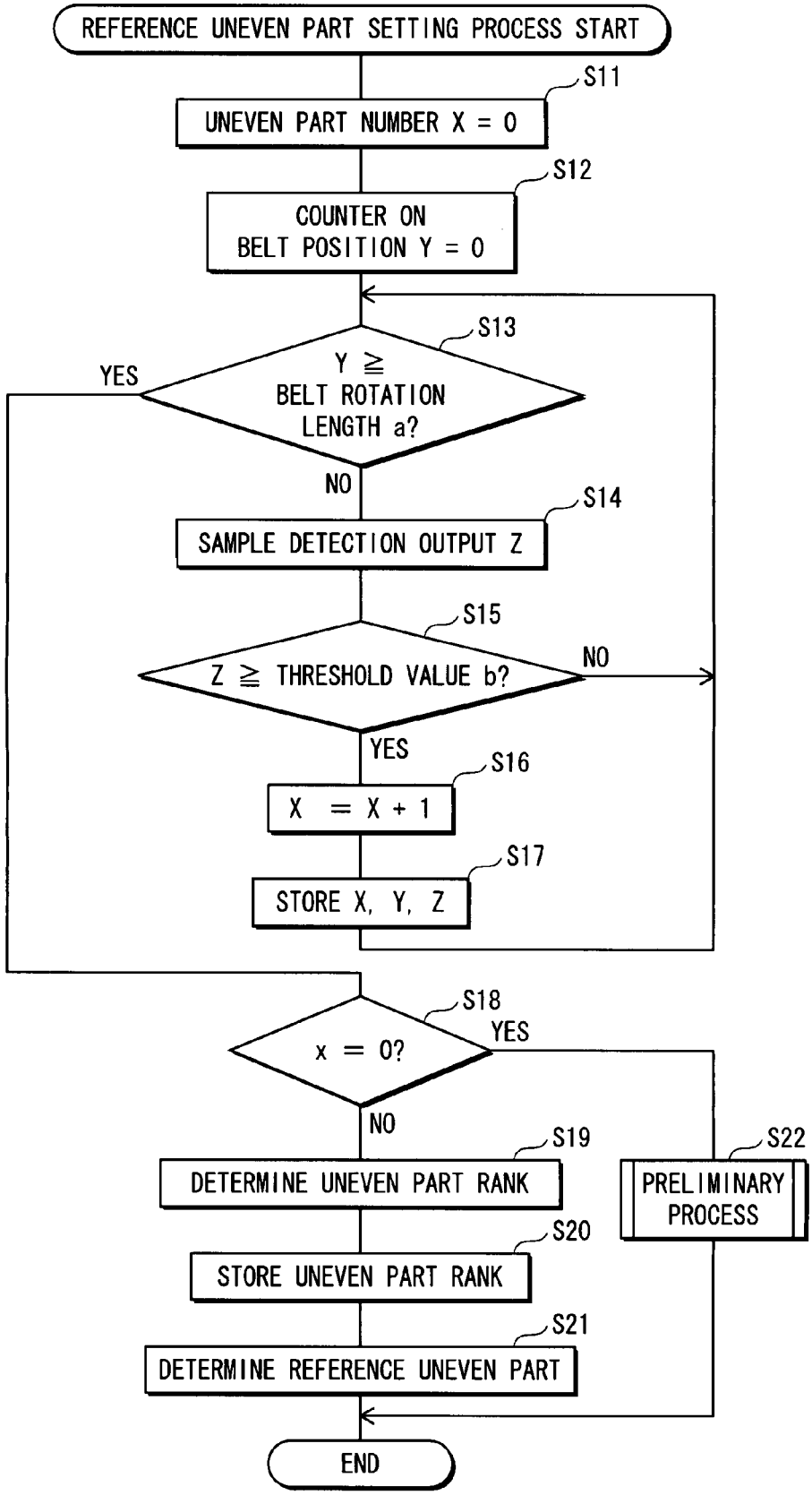
FIG. 3 is a flow chart showing a procedure of a reference uneven part setting process.

FIG. 3 is a flowchart showing a procedure of the reference uneven part setting process. As shown in FIG. 3, when the process is started, firstly, the uneven part number X is set to "0" (step S11), and a counter of the belt position Y (a movement distance from a position, from which sampling should start, to a running direction of the intermediate transfer belt 21) is reset to "0" (step S12).

Next, a value of the belt position Y is judged to be equal to or larger than a rotation length a of the intermediate transfer belt 21 (step S13), when the value of the belt position Y is judged to be smaller than the rotation length a ("NO" in step S13), the detection output Z (a detection value) is sampled based on a signal transmitted from the uneven part detecting unit 50 (step S14). The sampled detection output Z is compared with a threshold value b to distinguish whether the output is caused by a proper signal or by a noise and the like (step S15).

Figures 4, 5:
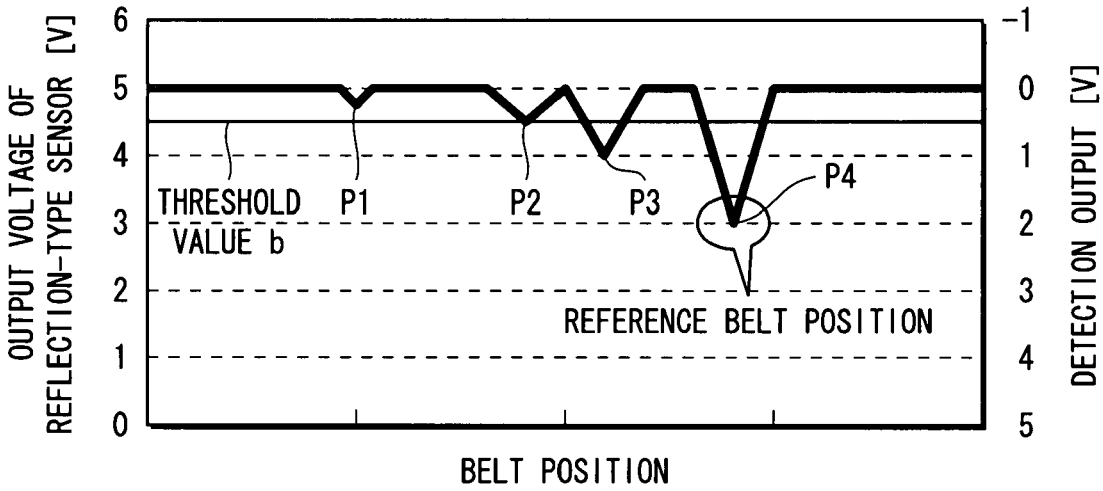
FIG. 4 shows one example of a detection waveform for one rotation of an intermediate transfer belt.
FIG. 5 shows a data table in which uneven part information is stored.

FIG. 4 shows one example of a detection waveform for one rotation of the intermediate transfer belt. A vertical axis on a left side of the FIG. 4 represents output voltage of a reflection-type sensor [V], and a vertical axis on a right side represents the detection output Z [V].

As the waveform shows in FIG. 4, the output voltage of the reflection-type sensor stays constant at 5.0 [V] when an uneven part is not detected. However, the output voltage of the reflection-type sensor drops and a peak appears when an uneven part is detected.

For example, in a belt position of an uneven part corresponding to a peak P1, the output voltage of the reflection-type sensor drops to 4.7 [V], down by 0.3 [V] from 5.0 [V]. In a belt position of an uneven part corresponding to a peak P2, the output voltage drops to 4.5 [V], down by 0.5 [V] from 5.0 [V] . In a belt position of an uneven part corresponding to a peak P3, the output voltage drops to 4.0 [V], down by 1.0 [V] from 5.0 [V]. And in a belt position of an uneven part corresponding to a peak P4, the output voltage drops to 3.0 [V], down by 2.0 [V] from 5.0 [V].

The detection output Z is obtained, for example, by an extent of the voltage drop i.e. by a voltage differential (a change volume) between output voltage of the reflection-type sensor when an uneven part is not detected and output voltage of the reflection-type sensor in each belt position. For example, in the belt position of the uneven part corresponding to the peak P1, the detection output Z is 0.3 [V] because the output voltage of the reflection-type sensor drops down by 0.3 [V]. In the belt position of the uneven part corresponding to the peak P2, the detection output Z is 0.5 [V] because the output voltage of the reflection-type sensor drops down by 0.5 [V]. In the belt position of the uneven part corresponding to the peak P3, the detection output Z is 1.0 [V] because the output voltage of the reflection-type sensor drops down by 1.0 [V]. And in the belt position of the uneven part corresponding to the peak P4, the detection output Z is 2.0 [V] because the output voltage of the reflection-type sensor drops down by 2.0 [V].

As shown in FIG. 4, when the threshold value b is set to a value (0.5 [V]) that is indicated in FIG. 4, among the peaks P1 to P4, the peak 1 having the detection output Z that is smaller than the threshold value b (the detection output Z=0.3 [V]) is judged to be an output caused by a noise and the like. The peaks P2 (the detection output Z=0.5 [V]), P3 (the detection output Z=1.0 [V]), and P4 (the detection output Z=2.0 [V]), having the detection outputs Z that are equal to or larger than the threshold value b, are judged to be outputs caused by uneven parts. In other words, it is judged that there are uneven parts in the belt positions Y in which the peaks P2 to P4 are detected.

When the detection output Z that is equal to or larger than the threshold value b is confirmed ("YES" in step S15), it is judged that there is an uneven part in the belt position Y in which the detection output Z is detected, and the uneven part number X is incremented by 1 (step S16). Then, the uneven part number X, the belt position Y, and the detection output Z and the like are defined as the uneven part information, and the uneven part information for one rotation of the intermediate transfer belt 21 is stored in the data table (step S17), and the process returns to step S13. Note that the data table is stored in the storage unit 78.

FIG. 5 shows the data table in which the uneven part information is stored. In the data table shown in FIG. 5, uneven part information whose uneven part number is "1" corresponds to the peak P2 in FIG. 4, uneven part information whose uneven part number is "2" corresponds to the peak P3, and uneven part information whose uneven part number is "3" corresponds to the peak P4.

Back to step S15, when the detection output Z is smaller than the threshold value b ("NO" in step S15), the detected peak is judged to be an output caused by a noise and the like, and the process returns to step S13 without storing the uneven part information.

Next, when a value of the belt position Y is judged to be smaller than the rotation length a ("NO" in step S13), the sampling of the detection output Z is continued (step S14). On the other hand, when the value of the belt position Y is judged to be equal to or larger than the rotation length a ("YES" in step S13), the sampling is ended and the uneven part number X is judged to be "0" (step S18).

When the uneven part number X is not "0" ("NO" in step 18) i.e. when at least one uneven part is detected, the uneven part rank is determined by referring to the data table (step S19). The uneven part rank is one of the uneven part information, and uneven parts are ranked in descending order of the detection output Z, such as "1", "2", "3" . . . and the like. In an example shown in FIG. 4, with regard to the uneven part whose uneven part number is "3" (which corresponds to the peak P4: the detection output Z=2.0 [V]), the uneven part rank is "1". In the same manner as this, with regard to the uneven part whose uneven part number is "2" (which corresponds to the peak P3: the detection output Z=1.0 [V]), the uneven part rank is "2". And, with regard to the uneven part whose uneven part number is "1" (which corresponds to the peak P2: the detection output Z=0.5 [V]), the uneven part rank is "3".

Then, the uneven part ranks are stored in the data table (step S20), and the uneven part whose uneven part rank is "1" (the uneven part whose uneven part number is "3", and corresponding to the peak P4 in FIG. 5) is determined as a reference uneven part (step S21).

Back to step S18, when the uneven part number X is "0" ("YES" in step 18) i.e. when no uneven part is detected, a preliminary process is performed (step S22). The preliminary process is performed if no uneven part is detected by using the specified threshold value b, and the same process mentioned above is performed again using a threshold value b' that is a smaller value than the specified threshold value b.

The threshold value b is set to a detectable value of a weld, a bump, or a line in a normal size that is expected to be on the intermediate transfer belt 21. Therefore, it is rare that no uneven part is detected when using the threshold value b, but the preliminary process is provided for dealing with such a rare case.

3. Reference Uneven Part Updating Process

The reference uneven part setting unit 74 performs a reference uneven part updating process. When an uneven part having a larger detection output Z than that of a reference uneven part which has been already set is detected, the reference uneven part setting unit 74 updates the reference uneven part to the uneven part having the larger detection output Z as a new reference uneven part. The reference uneven part updating process is performed at a predetermined timing that is described later.

Figure 6A:
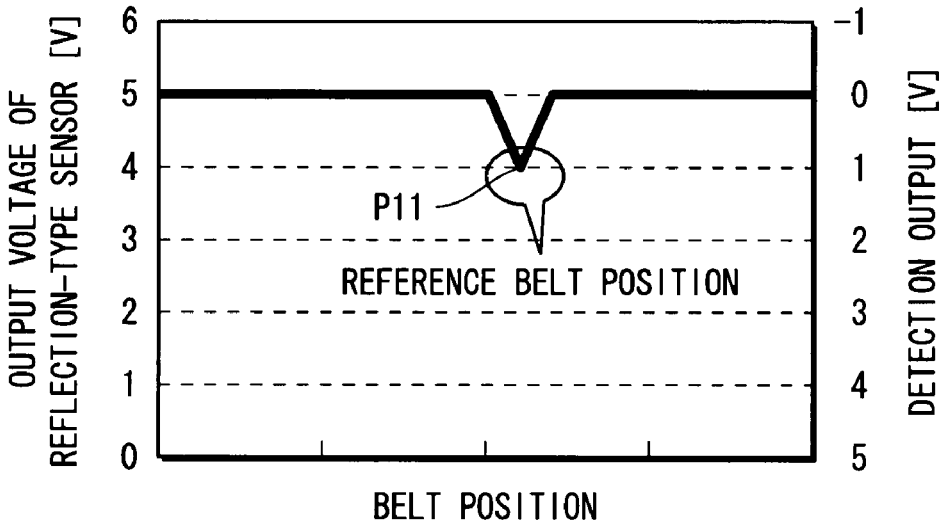
FIGS. 6A-6B show one example of a detection waveform for one rotation of an intermediate transfer belt.
Figure 6B:
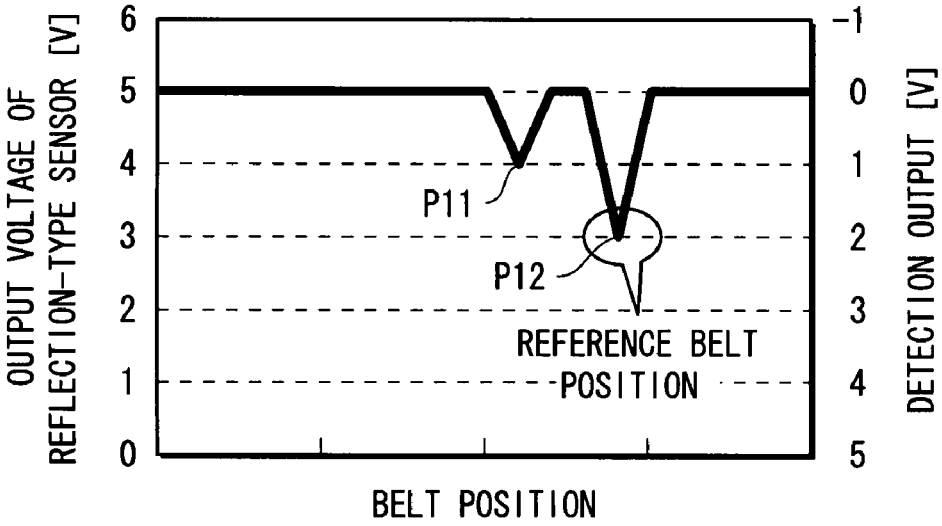

FIG. 6 shows one example of a detection waveform for one rotation of the intermediate transfer belt. Suppose, sampled detection output Z is represented by a waveform shown in FIG. 6(*a*), and an uneven part corresponding to a peak P11 is set as a reference uneven part. After that, the reference uneven part updating process is performed and newly sampled detection output Z is represented by a waveform shown in FIG. 6(*b*). When a peak P12 which is larger than the peak P11 is detected, an uneven part corresponding to the peak P12 is set as a new reference uneven part.

Figure 7:
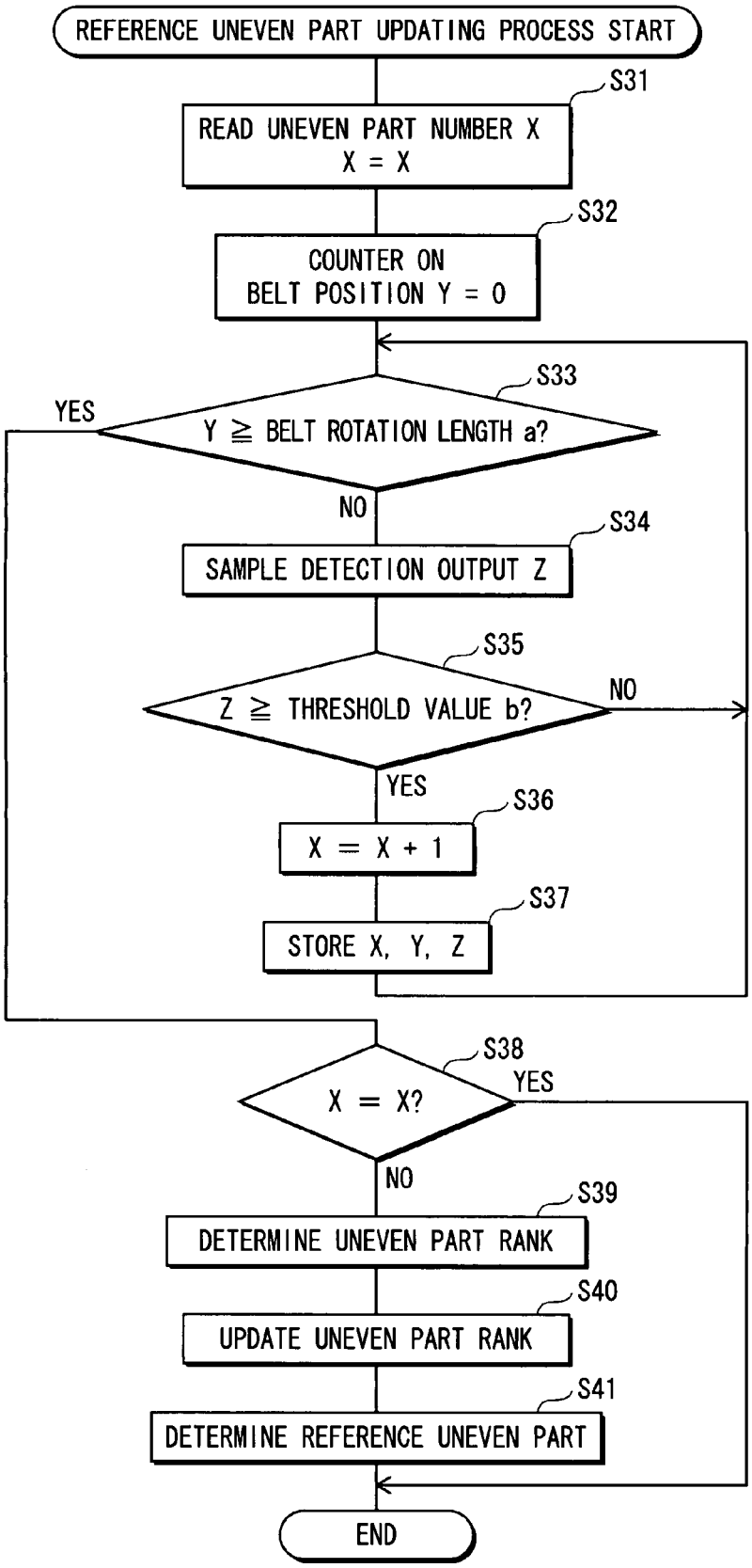
FIG. 7 is a flowchart showing a procedure of a reference uneven part updating process.

FIG. 7 is a flowchart showing the procedure of the reference uneven part updating process. As shown in FIG. 7, when the process is started, firstly, the uneven part information is read from the data table in the storage unit 78 and the uneven part number X is set to "X (the maximum value in a column of the uneven part number X)" (step S31). Also, the counter of the belt position Y is reset to "0" (step S32).

Next, a value of a current belt position Y is judged to be equal to or larger than the rotation length a of the intermediate transfer belt 21 (step S33), when the value of the belt position Y is judged to be smaller than the rotation length a ("NO" in step S33), the detection output Z is sampled based on a signal transmitted from the uneven part detecting unit 50 (step S34). Then, the detection output Z is compared with the threshold value b (step S35), when the detection output Z which is equal to or larger than the threshold value b is confirmed ("YES" in step S35), the uneven part number X is incremented by 1 (step S36), the uneven part number X, the belt position Y, and the detection output Z and the like are stored in the data table in the storage unit 78 as the uneven part information (step S37), and the process returns to step S33.

Back to step S35, when the detection output Z is smaller than the threshold value b ("NO" in step S35), the process returns to step S33 without storing the uneven part information.

When a value of the belt position Y is judged to be smaller than the rotation length a ("NO" in step S33), the sampling of the detection output Z is continued (step S34). On the other hand, when the value of the belt position Y is judged to be equal to or larger than the rotation length a ("YES" in step S33), the uneven part number X is judged to be "X" (step S38).

When the uneven part number X is not "X" ("NO" in step 38), the uneven part rank is determined by referring to the data table (step S39). In the example shown in FIG. 6(*b*), because the detection output Z of the peak P12, which newly appears, is the maximum, the uneven part rank of the uneven part corresponding to the peak P12 is determined as "1", and the uneven part rank of the uneven part corresponding to the peak P11 is determined as "2". Then, the uneven part ranks in the data table are updated (step S40). Moreover, the uneven part corresponding to the peak P12, whose uneven part rank is newly determined as "1", is determined as a new reference uneven part (step S41).

Back to step S38, when the uneven part number X is "X" ("YES" in step S38), because there is no need to update the reference uneven part which is set in the preliminary process in the reference uneven part setting process, the reference uneven part updating process is ended without updating the reference uneven part.

4. Reference Uneven Part Distinguishing Process

When toner images of different colors are transferred in layers onto the intermediate transfer belt 21, the reference uneven part distinguishing unit 75 performs a reference uneven part distinguishing process, distinguishes a reference uneven part, and specifies a reference belt position. In other words, the reference uneven part distinguishing unit 75 specifies a location of the intermediate transfer belt 21 as the reference belt position based on a result of detecting an uneven part by the uneven part detecting unit 50. The image control unit 72 controls a timing at which the toner images are formed based on the reference belt position that is defined by the reference uneven part.

Figure 8:
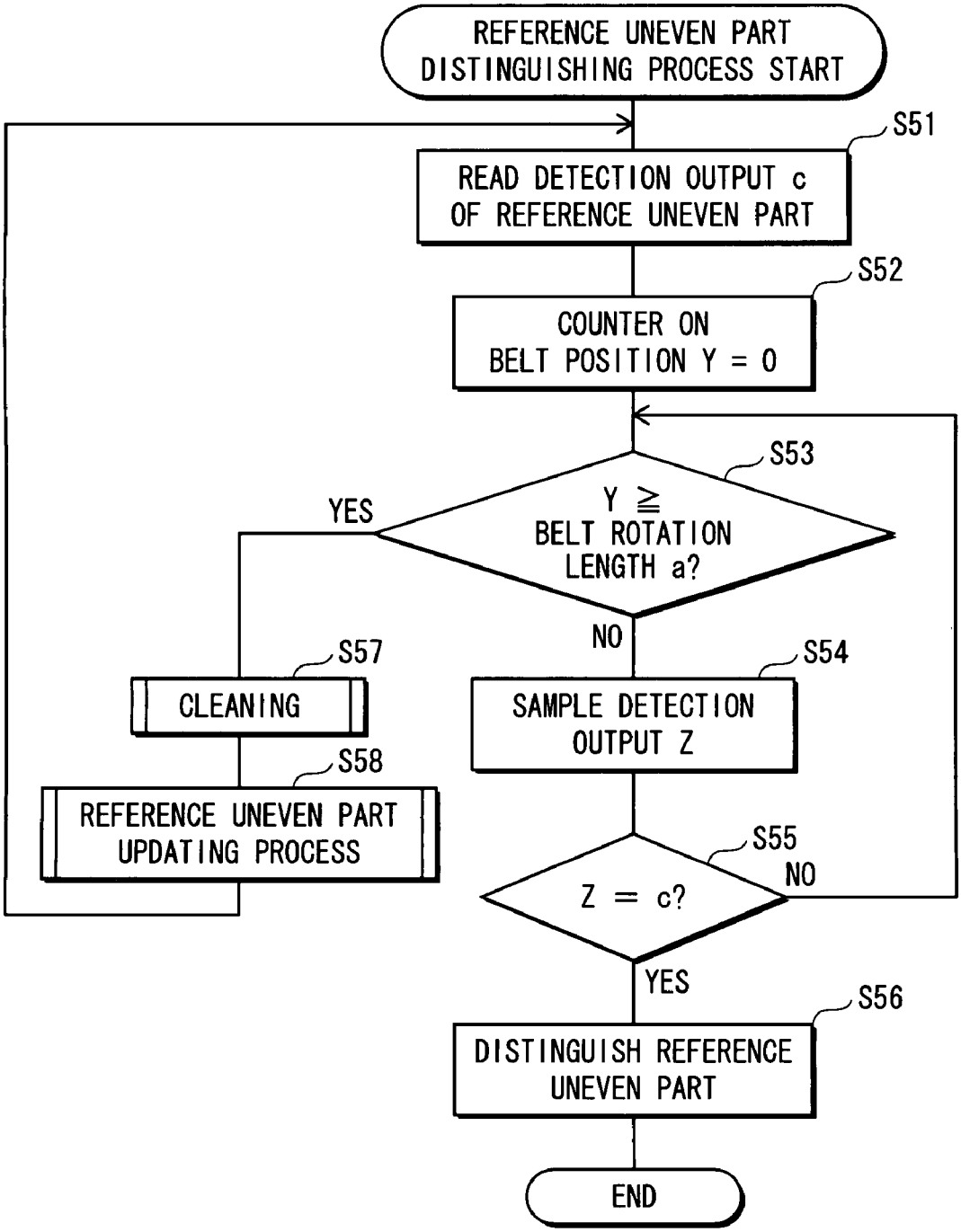
FIG. 8 is a flowchart showing a procedure of a reference uneven part distinguishing process.

FIG. 8 is a flowchart showing a procedure of the reference uneven part distinguishing process. As shown in FIG. 8, when the process is started, firstly, a detection output c of a reference uneven part is read as a reference uneven part value from the data table in the storage unit 78 (step S51). More specifically, a detection output Z of an uneven part, whose uneven part rank is "1", is read by referring to the data table. Also, the counter of the belt position Y is reset to "0" (step S52)

Next, a value of the belt position Y is judged to be equal to or larger than the rotation length a of the intermediate transfer belt 21 (step S53), when the value of the belt position Y is judged to be smaller than the rotation length a ("NO" in step S53), a detection output Z is sampled based on a signal transmitted from the uneven part detecting unit 50 (step S54)

Then, the sampled detection output Z is compared with the detection output c of the reference uneven part (step S55), when the detection output Z is identical to the detection output c ("YES" in step S55), an uneven part included in the belt position Y in which the detection output Z is detected, is distinguished as a reference uneven part (step S56), and the belt position Y is specified as a reference belt position.

Note that a reference uneven part value is not limited, to the detection output c of a reference uneven part. The reference uneven part value may be a value, between a value having a biggest change volume and a value having a second biggest change volume, among detection outputs Z of each of uneven parts stored in the storage unit 78. With this construction, even if the reference uneven part is not completely identical to the detection output Z because of a detection error, the reference uneven part can be distinguished.

Also, in step S55, whether or not the detection output Z is identical to the detection output c is judged by whether or not the detection output Z is completely identical to the detection output c. However, the judgment is not limited to such case and may be judged whether or not the detection output Z is within a certain level of an allowable range that is set for the detection output c. The allowable range may be a range of a detection error because there is a case where the detection output c cannot be obtained with accuracy because of the detection error. If the allowable range is broadened too much, there is the possibility that an uneven part other than a reference uneven part is distinguished as a reference uneven part by mistake. Therefore, the allowable range should be set to the extent that the range can be regarded as the detection output Z of the reference uneven part. As a specific example, a middle value of the allowable range is defined as the detection output c of the reference uneven part, and based on the middle value, an upper limit and a lower limit are set in view of the detection error.

Back to step S55, when the detection output Z is not identical to the detection output c ("NO" in step S55), the process returns to step S53 and the detection output Z is sampled until the value of the belt position Y is judged to be equal to or larger than the rotation length a (steps S53 and S54), and the detection output Z is continued comparing with the detection output c (step S55).

When the value of the belt position Y is judged to be equal to or larger than the rotation length awhile the detection output Z is not identical to the detection output c ("YES" in step S53), an whole area of the intermediate transfer belt 21 is cleaned by the cleaner 29 (step S57).

Figure 9:
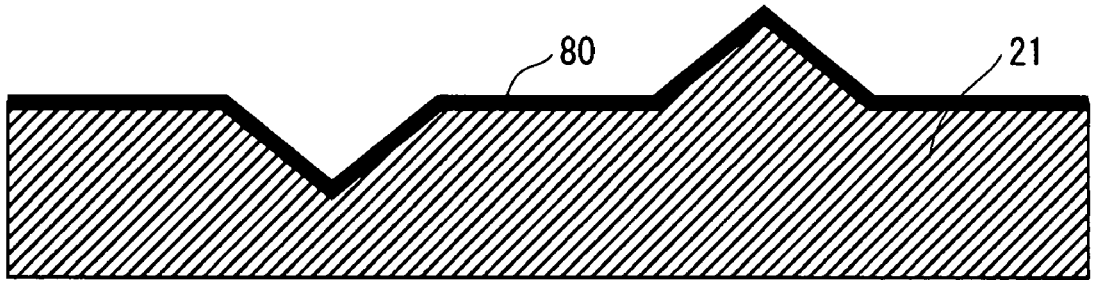
FIG. 9 shows a surface state of an intermediate transfer belt that is soiled by toner dust.

FIG. 9 shows a surface state of the intermediate transfer belt 21 that is soiled by toner dust. As shown in FIG. 9, when the surface of the intermediate transfer belt 21 is soiled by toner dust 80, there is the possibility that a detection output Z of a reference uneven part cannot be sampled with accuracy and a detection output Z, which is identical to the detection output c, cannot be detected. In this case, a non-image area, that is not normally cleaned, is cleaned by the cleaner 29.

Note that a reason why a non-image area is not normally cleaned is that the cleaner blade 28 is damaged easily if the cleaner blade 28 is contacted with the non-image area which includes an uneven part.

After the cleaning, the reference uneven part updating process is performed (step S58), and the reference uneven part is updated. Then, the process returns to step S51 to distinguish the reference uneven part again.

With regard to the reference uneven part distinguishing process mentioned above, there is a following modification.

The reference uneven part distinguishing process of the modification does not judge whether or not the detection output Z is identical to the detection output c, but judges whether or not the detection output Z is equal to or larger than a predetermined value T. This is a difference between the reference uneven part distinguishing process of the modification and the reference uneven part distinguishing process described previously. Except for the difference, the reference uneven part distinguishing process of the modification is basically the same as the reference uneven part distinguishing process described previously. Therefore, only the difference is described in details.

Figure 10:
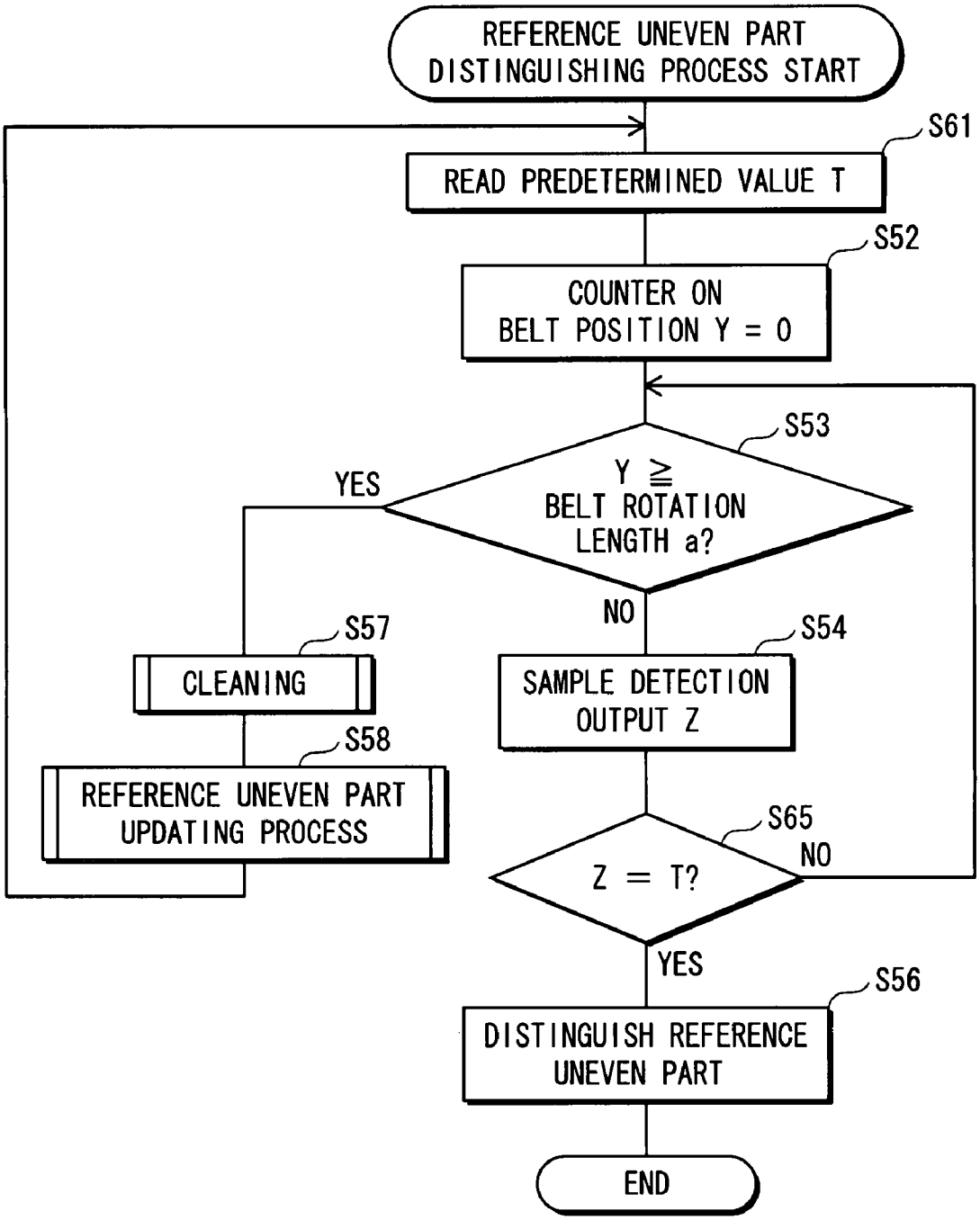
FIG. 10 is a flow chart showing a procedure of a reference uneven part distinguishing process of a modification.

FIG. 10 is a flowchart showing a procedure of the reference uneven part distinguishing process of the modification. Note that in the flowchart of FIG. 10, same symbols are used for steps in common with the flowchart of FIG. 8, and new symbols are used for only different steps.

When the process is started, firstly, the predetermined value T is read from the data table in the storage unit 78 (step S61). The predetermined value T is, for example, an average value of a detection output value of an uneven part whose uneven part rank is "1" and a detection output value of an uneven part whose uneven part rank is "2". Also, the predetermined value T is calculated and stored in the data table when the reference uneven part setting process is performed. Note that the predetermined value T is not limited to the average value of the detection output value of the uneven part whose uneven part rank is "1" and the detection output value of the uneven part whose uneven part rank is "2". The predetermined value T may be any value set between the detection output value of the uneven part whose uneven part rank is "1" and the detection output value of the uneven part whose uneven part rank is "2".

Next, steps S52 to S54 are performed in sequence, a sampled detection output Z is compared with the predetermined value T (step S65). Then, when the detection output Z is judged to be equal to or larger than the predetermined value T ("YES" in step S65), an uneven part included in a belt position Y in which the detection output Z is detected, is distinguished as a reference uneven part (step S56), and the belt position Y is specified as a reference belt position.

Back to step S65, when the detection output Z is not judged to be equal to or larger than the predetermined value T ("NO" in step S65), the process returns to step S53 and the detection output Z is sampled until a value of the belt position Y is judged to be equal to or larger than the rotation length a (steps S53 and S54), and the detection output Z is continued comparing with the predetermined value T (step S65).

When the value of the belt position Y is judged to be equal to or larger than the rotation length awhile the detection output Z is not judged to be equal to or larger than the predetermined value T ("YES" in step S53), after performing steps S57 and S58, the process returns to step S61 to distinguish the reference uneven part again.

5. Image Area Determining Process

The image area determining unit 76 performs an image area determining process, and determines a suitable location of an image area for forming a toner image on the surface of the intermediate transfer belt 21. Whether or not the location of the image area is suitable for forming the toner image is judged whether or not the location of the image area includes an uneven part. In a location of an image area that does not include an uneven part, a transfer density unevenness is unlikely to occur, so a high quality toner image can be formed.

Figure 11A:
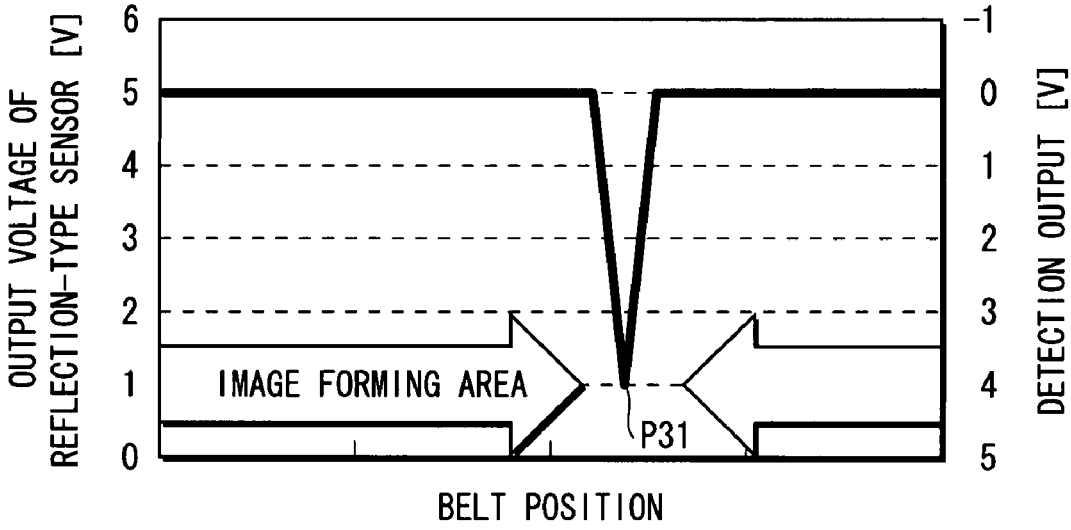
FIGS. 11A-11B show one example of a detection waveform for one rotation of an intermediate transfer belt.
Figure 11B:
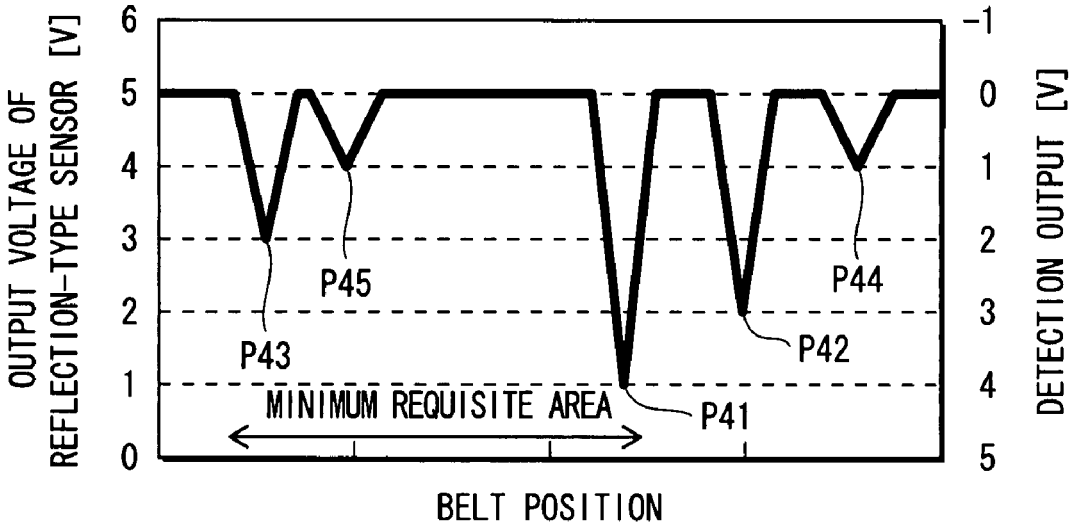

Firstly, an outline of the image area determining process will be described briefly. FIG. 11 shows one example of a detection waveform for one rotation of the intermediate transfer belt. Suppose, a sampled detection output Z is represented by a waveform shown in FIG. 11(*a*), and an uneven part corresponding to a peak P31 is set as a reference uneven part. In this case, as shown in FIG. 11(*a*), an area other than an area including a reference uneven part is determined as an image area.

Figure 12:
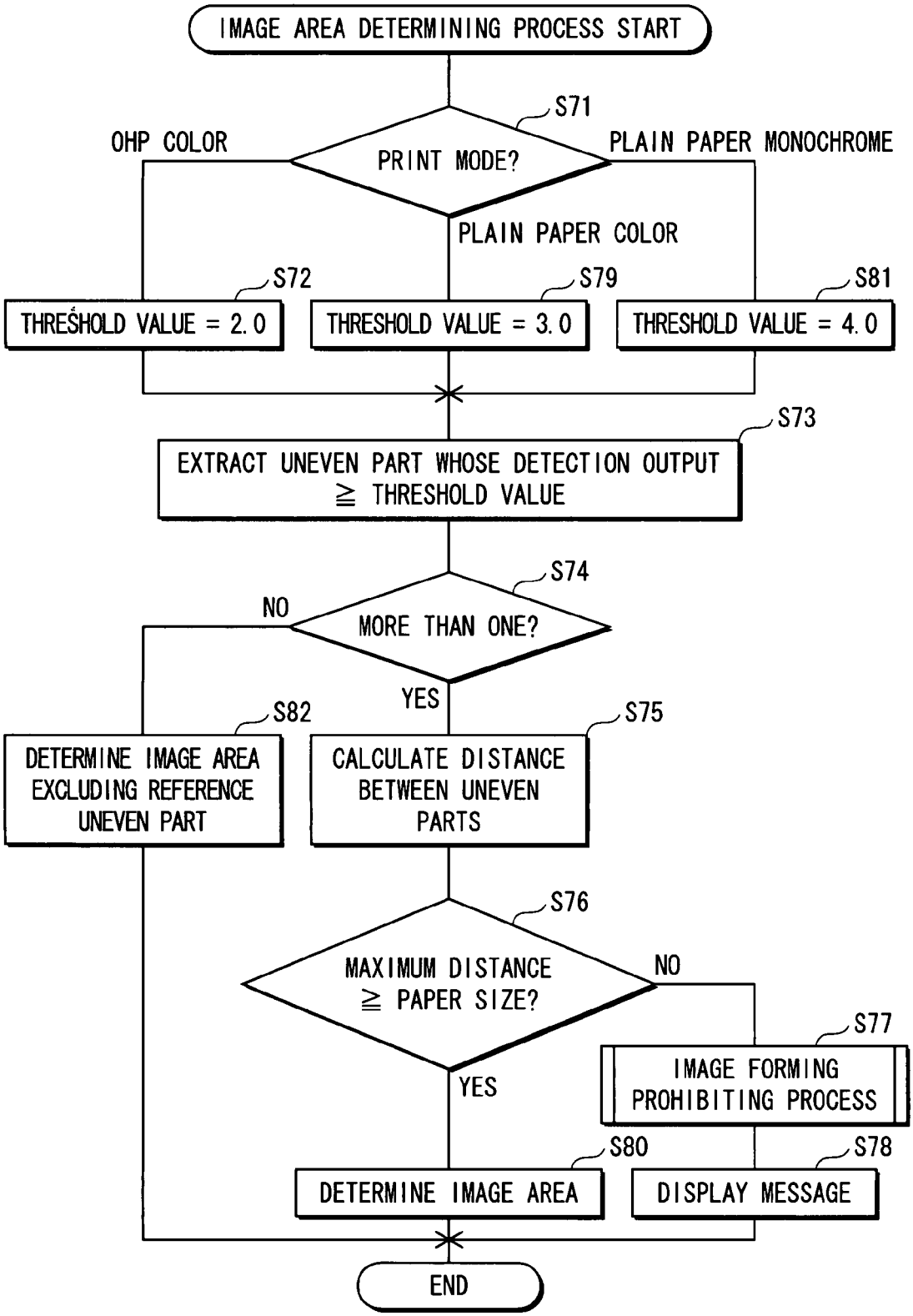
FIG. 12 is a flowchart showing a procedure of an image area determining process.

FIG. 12 is a flowchart showing a procedure of the image area determining process. The image area determining process will be described in details with an example of the following case. The case is that a sampled detection output Z is represented by a wave form shown in FIG. 11(*b*), and an uneven part corresponding to a peak P41 is set as a reference uneven part.

As shown in FIG. 12, when the process is started, firstly, a print mode as a color mode is judged (step S71). This is because an influence of an uneven part on an image quality is different according to the print mode.

Figure 13:
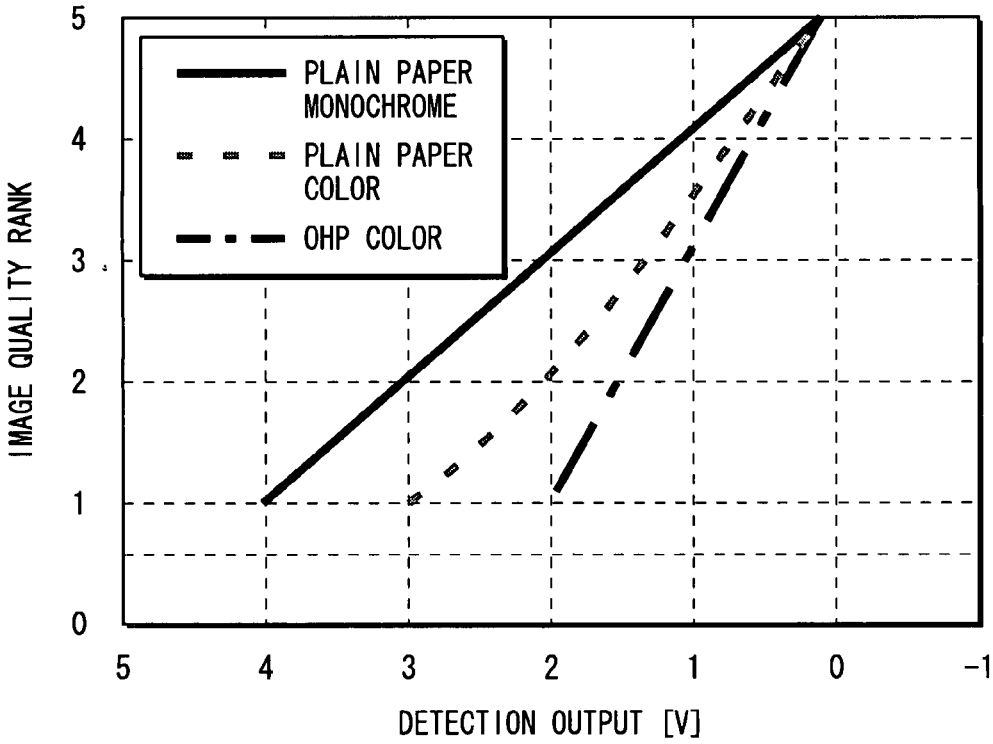
FIG. 13 shows a relation between a detection output and an image quality.

FIG. 13 shows a relation between a detection output and the image quality. As shown in FIG. 13, because the output of the reflection-type sensor is 5.0 [V] when an uneven part is not detected, the detection output Z is 0 [V] In this case, each of image quality ranks of an OHP color mode, a plain paper color mode, and a plain paper monochrome mode is "5", and the image quality is in a good condition. However, when the detection output Z is 2.0 [V] (when the output voltage of the reflection-type sensor is 3.0 [V]), the image quality rank of the OHP color mode goes down to "1" which is regarded as a problem in the image quality. On the other hand, the image quality rank of the plain paper color mode is "2", and the image quality rank of the plain paper monochrome mode is "13". These image quality ranks are within an allowable range in the image quality.

When the detection output Z is 3.0 [V], each of the image quality ranks of the OHP color mode and the plain paper color mode goes down to "1". On the other hand, the image quality rank of the plain paper monochrome mode does not go down to "1". When the detection output Z is 4.0 [V], all image quality ranks of the OHP color mode, the plain paper color mode, and the plain paper monochrome mode go down to "1". As mentioned above, each of the image qualities of the OHP color mode, the plain paper color mode, and the plain paper monochrome mode has a different influence of an uneven part.

When the print mode is the OHP color mode in a print job ("OHP color" in step S71), a threshold value is set to 2.0 [V] (step S72), uneven parts having detection outputs Z that are equal to or larger than the threshold value, are extracted from the data table in the storage unit 78 (step S73).

Next, whether or not the number of the uneven parts having the detection outputs Z that are equal to or larger than the threshold value, is more than one (step S74). In a case of the example shown in FIG. 11(*b*), among uneven parts corresponding to peaks P41 to P45, the uneven parts having the detection outputs Z that are equal to or larger than the threshold value 2.0 [V], are the uneven parts corresponding to the peaks P41 to P43. In other words, the number of the uneven parts having the detection output Z that are equal to or larger than the threshold value, is more than one ("YES" in step S74).

Then, each of distances between the uneven part corresponding to the peak P41 and the uneven part corresponding to the peak P42 (the distance means the distance between the uneven part corresponding to the peak P41 and the uneven part corresponding to the peak P42 toward down stream of the intermediate transfer belt 21. Same applies to the following.), between the uneven part corresponding to the peak P42 and the uneven part corresponding to the peak P43, and between the uneven part corresponding to the peak P43 and the uneven part corresponding to the peak P41, is calculated (step S75). Each of the distances is calculated by doing subtraction of the belt position Y in the data table.

Next, the maximum distance between the uneven parts is judged to be equal to or larger than a paper size (step S76). In a case of the example shown in FIG. 11(*b*), the maximum distance between the uneven parts is the distance between the uneven part corresponding to the peak P43 and the uneven part corresponding to the peak P41.

However, as shown in FIG. 11(*b*), because the distance between the uneven part corresponding to the peak P43 and the uneven part corresponding to the peak P41 is smaller than a minimum requisite area (a size of the sheet 31) ("NO" in step S76), an image area cannot be secured. In other words, the image area includes the uneven part having the detection output Z that is equal to or larger than the threshold value. In this case, the image quality is reduced because of the uneven part.

Therefore, an image forming prohibiting process is performed (step S77), and the image control unit 72 is prohibited from forming a toner image on the photosensitive drum 11. Also, the displaying unit 60 displays a predetermined message such as "It is impossible to form the image" (step S78).

With regard to the minimum requisite area, for example, when the sheet 31 is A4 in size, a measurement of the sheet 31 along the rotation of the intermediate transfer belt 21 is about 300 [mm]. In this case, the distance between the uneven part corresponding to the peak P43 and the uneven part corresponding to the peak P41 is required to be equal to or larger than at least 300 [mm] along the rotation of the intermediate transfer belt 21.

When the print mode is the plain paper color mode in the print job ("plain paper color" in step S71), a threshold value is set to 3.0 [V] (step S79).

Then, uneven parts having detection outputs Z that are equal to or larger than the threshold value, are extracted by referring to the data table in the storage unit 78 (step S73), and whether or not the number of the uneven parts having the detection outputs Z that are equal to or larger than the threshold value, is judged to be more than one (step S74). In the case of the example shown in FIG. 11(*b*), among the uneven parts corresponding to the peaks P41 to P45, the uneven parts having the detection outputs Z that are equal to or larger than the threshold value 3.0 [V] , are the uneven parts corresponding to the peaks P41 and P42. In other words, the number of the uneven parts having the detection outputs Z that are equal to or larger than the threshold value, is more than one ("YES" in step S74).

Next, each of the distances between the uneven part corresponding to the peak P41 and the uneven part corresponding to the peak P42, and between the uneven part corresponding to the peak P42 and the uneven part corresponding to the peak P41 is calculated (step S75). Each of the distances is calculated by doing subtraction of the belt position Y in the data table.

Then, the maximum distance between the uneven parts is judged to be equal to or larger than a paper size (step S76). In the case of the example shown in FIG. 11(*b*), the maximum distance between the uneven parts is the distance between the uneven part corresponding to the peak P42 and the uneven part corresponding to the peak P41. As shown in FIG. 11(*b*), because the distance between the uneven part corresponding to the peak P42 and the uneven part corresponding to the peak P41 is equal to or larger than the minimum requisite area ("YES" instep S76), an area between the uneven part corresponding to the peak P42 and the uneven part corresponding to the peak P41 is determined as an image area (step S80).

When the print mode is the plain paper monochrome mode in the print job ("plain paper monochrome" in step S71), a threshold value is set to 4.0 [V] (step S81).

Then, uneven parts having detection outputs Z that are equal to or larger than the threshold value, are extracted by referring to the data table in the storage unit 78 (step S73), and whether or not the number of the uneven parts having the detection outputs Z that are equal to or larger than the threshold value, is judged to be more than one (step S74). In the case of the example shown in FIG. 11(*b*), among the uneven parts corresponding to the peaks P41 to P45, the uneven part having the detection output Z that is equal to or larger than the threshold value 4.0 [V], is only the uneven part corresponding to the peak P41. In other words, the number of the uneven parts having the detection outputs Z that are equal to or larger than the threshold value, is not more than one ("NO" in step S74). In this case, an area other than an area including a reference uneven part is determined as an image area (step S82).

Although the above-mentioned threshold value is set according to the print modes, the threshold value may be set according to a type of the sheet 31, a size of the sheet 31, the combination of the type and the size or the like. With this construction, there is no possibility that the forming of toner images is prohibited to secure the quality excessively.

Also, the cases, where the image forming prohibiting process is performed or where the displaying unit displays the message such as "It is impossible to form the image", are not limited to the case where it is judged that an image area cannot be secured. For example, when an integrated detection output of uneven parts detected for one rotation of an intermediate transfer member is equal to or larger than a predetermined value, the image forming prohibiting process may be performed or the displaying unit may display the message such as "It is impossible to form the image".

The cases, where the integrated detection output of uneven parts detected for one rotation of the intermediate transfer member is equal to or larger than the predetermined value, are such cases where an integrated value of peak width is equal to or larger than a predetermined value, where an integrated value of peak height is equal to or larger than a predetermined value, where the total number of peaks is equal to or larger than a predetermined value or the like.

Figure 14:
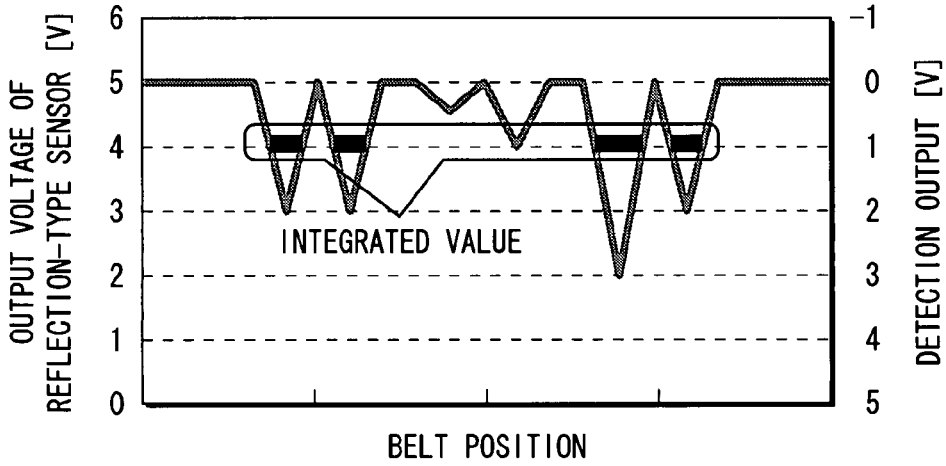
FIG. 14 shows one example of a detection waveform for one rotation of an intermediate transfer belt.

FIG. 14 shows one example of a detection waveform for one rotation of the intermediate transfer belt. As shown in FIG. 14, there is a case where an integrated value of peak width is equal to or larger than a predetermined value i.e. where a ratio of uneven parts for one rotation of the intermediate transfer belt, in the running direction of the intermediate transfer belt 21, is equal to or larger than the predetermined value. In this case, the image forming prohibiting process is performed and the displaying unit displays the message such as "It is impossible to form the image" because the uneven parts significantly reduces the image quality.

6. An Updating Timing Determining Process

An updating timing determining process, which judges a timing at which the reference uneven part updating process is performed, will be described. The updating timing determining process is performed according to a predetermined number of forming images (according to the predetermined number of prints or copies).

Figure 15:
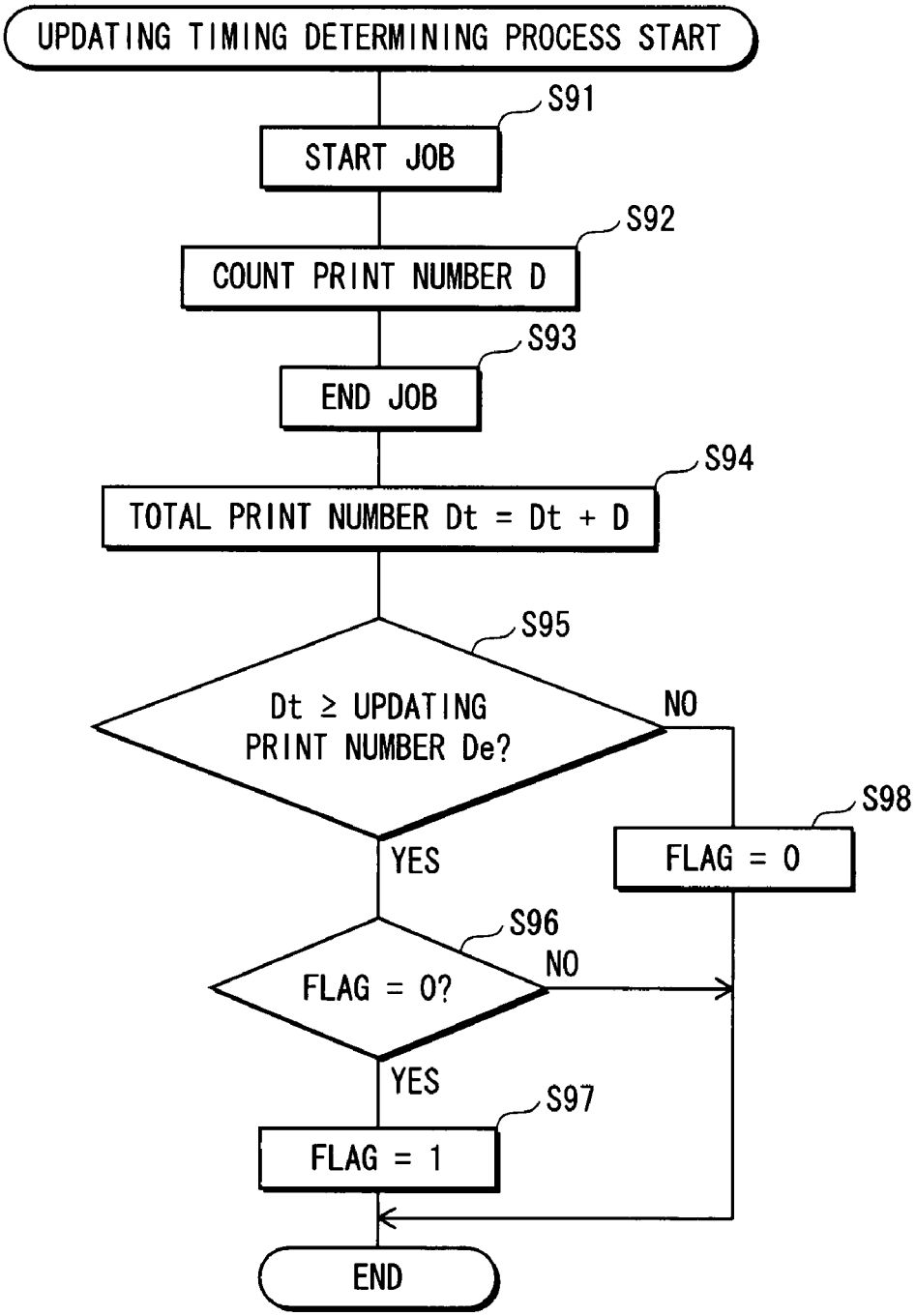
FIG. 15 is a flowchart showing a procedure of an updating timing determining process.

FIG. 15 is a flowchart showing a procedure of the updating timing determining process. As shown in FIG. 15, when a print job is started (step S91), the number of prints D, which are printed in the job, is counted (step S92).

When the print job is ended (step S93), the counted number of prints D is added to the total number of prints Dt stored in the storage unit 78, and the total number of prints Dt is updated to a value obtained by adding D to Dt (step S94).

It is then judged whether the total number of prints Dt is equal to or larger than the number of prints for updating De (step S95). Here, the number of prints for updating De is the number of prints that is expected to require the updating of a reference uneven part, and is preliminarily obtained through experiments and is stored in an internal ROM (not illustrated) or the like.

The number of prints for updating De is set to, for example, 10,000, in accordance with the properties of the printer 1. It should be noted here that the number of prints for updating De may be a varying value. For example, the number of prints for updating De may be set to 100 up to 1,000 prints after the start of use of the printer 1, and set to 1,000 thereafter.

If it is judged that the total number of prints Dt is equal to or larger than the number of prints for updating De ("YES" in step S95), it is judged whether or not a value of a flag stored in a flag storing unit is "0" (step S96).

If it is judged that the value of the flag is "0" ("YES" in step S96), the flag is set to "1" (step S97), and the process is ended.

Back to step S95, if it is judged that the total number of prints Dt is smaller than the number of prints for updating De ("NO" in step S95), the flag is set to "0" (step S98), and the process is ended.

The above-described updating timing determining process is performed each time a print job is performed, and if the number of prints reaches or exceeds a predetermined value, the flag is set to "1" to indicate that the updating timing has come.

Although the updating timing determining process is performed according to the predetermined number of prints, the updating timing determining process may be performed each time the printer 1 is turned on, each time a predetermined process such as the image forming process is performed, or each time a predetermined image forming operation time has passed. Also, the updating timing determining process may be performed according to the timing of the combination thereof. With this construction, the best condition of a reference uneven part can be maintained easily.

7. Cleaning Process

The cleaning of an image area on the surface of the intermediate transfer belt 21 is performed by the cleaner 29. However, the cleaning of a non-image area is not basically performed. Note that the method for determining the image area and the non-image area is as mentioned above.

The image area is required to be cleaned because a toner image is formed and remnant toners remain therein. However, the non-image area is not required to be cleaned frequently because a toner image is not formed and remnant toners does not remain therein. Also, when the image area is cleaned, the cleaner blade 28 is not damaged easily because the image area includes few uneven parts. However, when the non-image area is cleaned, the cleaner blade 28 is damaged easily because the non-image area includes more uneven parts.

However, when a predetermined condition is satisfied, the cleaning of the non-image area is also performed. For example, the cleaning is performed when a detection accuracy of uneven parts degrades. With this construction, when a surface of an intermediate transfer member is soiled by toner dust or toners composing toner fogging, the dirt is cleaned and the detection accuracy of the uneven parts can be improved.

The case where the detection accuracy of the uneven parts degrades is, for example, when a reference uneven part is not detected in the reference uneven part distinguishing process i.e. when an uneven part having a detection output Z that is identical to the detection output c of the reference uneven part is not detected ("NO" in step S55 in FIG. 8). Note that the cleaning of the non-image area may be performed each time the reference uneven part updating process is performed.

Meanwhile, when the integrated detection output of the peaks indicating the uneven parts is equal to or larger than the predetermined value, the cleaner blade 28 is damaged easily because the surface of the intermediate transfer belt 21 includes many uneven parts. The above-mentioned case includes: when the integrated value of the peak width of the uneven parts is equal to or larger than the predetermined value; when the integrated value of the peak height is equal to or larger than the predetermined value; or when the total number of the peaks is equal to or larger than the predetermined value. Therefore, in such cases, the cleaning is prohibited regardless of an image area or a non-image area. In addition, the displaying unit 60 displays a message such as "The intermediate transfer belt 21 is required to be exchanged because of the bad belt state".

<Modifications>

Up to now, the image forming device of the present invention has been described specifically through the embodiment. However, the technical scope of the present invention is not limited to the above-described embodiment.

For example, the image forming device of the present invention is not limited to a 4-cycle image forming device, but may be a tandem image forming device. The tandem image forming device also can form toner images on an area that includes few uneven parts, and produces an advantageous effect of improving the image quality. Also, an intermediate transfer member is not limited to an endless belt shape, but may be a drum shape.

The image forming device of the present invention is not limited to a construction in which an uneven part having a largest detection output is set as a reference uneven part, and may have a construction in which any one of uneven parts is set as a reference uneven part. In other words, an uneven part having a second highest detection output may be set as a reference uneven part. Also, a reference uneven part may be set by a characteristic as an indication except for a detection output, such as a shape of an uneven part. Moreover, a detection output is not limited to the peak height of the detection peak (the depth or the height of an uneven part), and may be a peak area (the volume of an uneven part), peak width (the width of an uneven part in the running direction of the intermediate transfer member) or the like.

Also, the image forming device of the present invention is not limited to a construction in which a detection output of a reference uneven part is stored in the storage unit, and may have a construction in which a reference uneven part is set each time a toner image is formed.

The uneven part detecting unit of the present invention is not limited to a reflection-type sensor, and may be a light transmission type sensor, or a CCD sensor which can detect uneven parts on the surface of the intermediate transfer belt. Furthermore, the sensors for image control other than the AIDC sensor such as an image density detection sensor, a resist detection sensor and the like may be also used as the uneven part detecting unit. Moreover, the sensor for image control is not used as the uneven part detecting unit, but the uneven part detecting unit may be provided separately from the sensor for image control.

Figure 16:
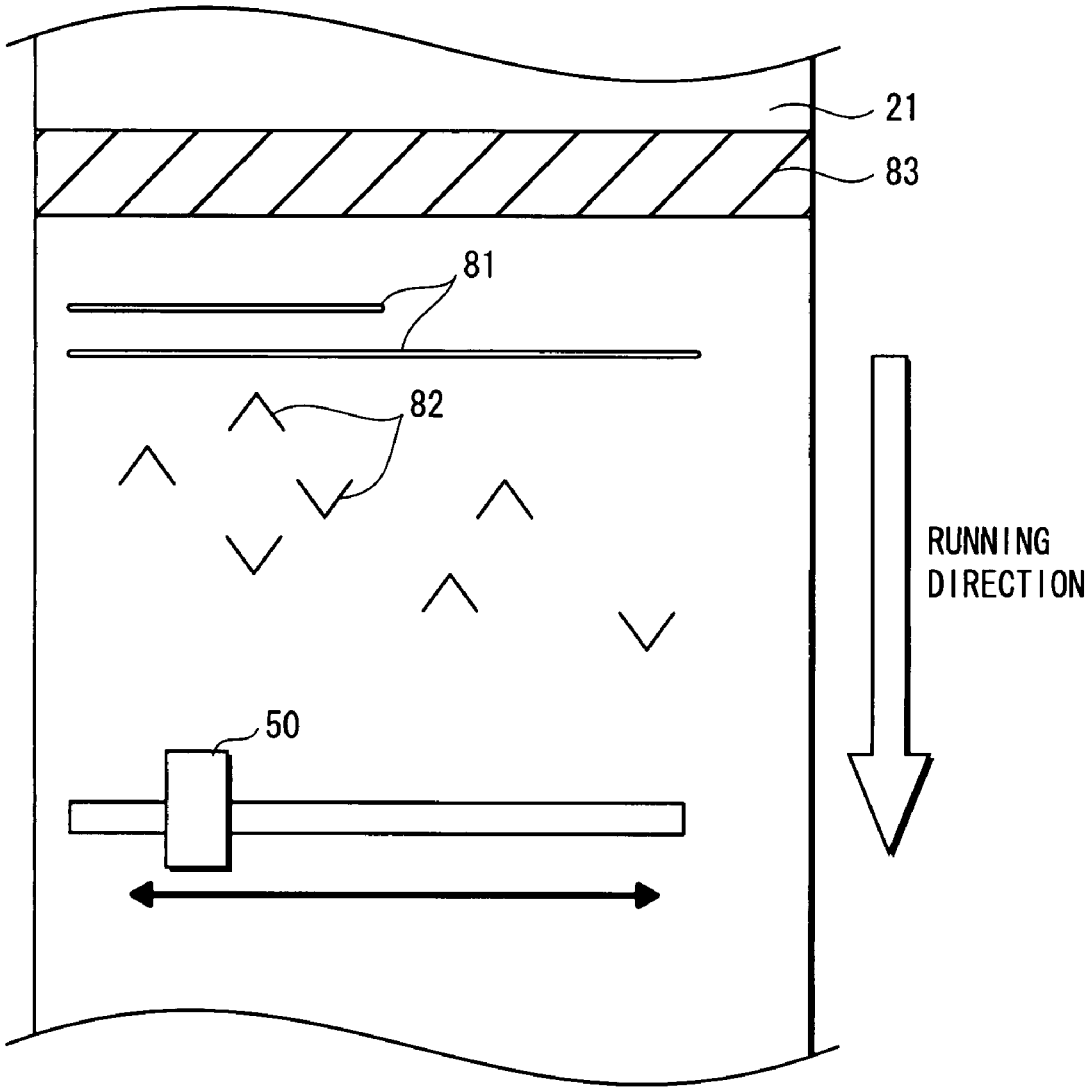
FIG. 16 describes an uneven part detecting unit of a modification.

FIG. 16 describes an uneven part detecting unit of the modification. The uneven part detecting unit is not limited to a construction in which uneven parts are detected only in the running direction of the intermediate transfer member. As shown in FIG. 16, the uneven part detecting unit may have a construction in which the uneven part detecting unit can move in a direction perpendicular to the running direction of the intermediate transfer member, and uneven parts such as a line 81, a bump 82, weld 83 and the like are detected throughout the intermediate transfer belt. With this construction, the uneven parts can be detected on a broader range of the surface of the intermediate transfer belt 21.

<Image Forming Method>

The present invention is not limited to an image forming device, but may be an image forming method or a program that has a computer execute the image forming method. The program achieving the present invention may be recorded on various computer-readable recording mediums such as: magnetic tape; a magnetic disk such as a flexible disk; an optical recording medium such as a DVD-ROM, a DVD-RAM, a CD-ROM, CD-R, MO, or PD; and a flash-memory-type recording medium. The present invention may be produced or transferred in the form of the above-mentioned recording medium, or may be sent or supplied in the form of the above-mentioned program via: one of various wired/wireless networks including the Internet; a broadcast; an electric communication line; a satellite communication or the like.

It is not necessary for the above-mentioned program to include all the modules for the above-described processes to be executed by the computer. For example, part of the processes of the present invention to be executed by the computer may be achieved by general-purpose programs that can be installed in an information processing device, such as the programs contained in a communication program or an operating system (OS). Accordingly, the recording medium of the present invention does not necessarily record all the above-mentioned modules, nor is it necessary to send all the modules. Furthermore, predetermined processes of the present invention may be executed using dedicated hardware.

INDUSTRIAL APPLICABILITY

The image forming device of the present invention can be used for printers, MFPs (Multi Function Peripherals), copy machines, facsimile machines and the like. The image forming device of the present invention can be used for monochrome printers, as well as full-color printers.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming device that transfers a plurality of toner images of different colors in layers, onto an intermediate transfer member by controlling a timing of forming each of the plurality of toner images, based on a reference position on a surface of the intermediate transfer member, the image forming device comprising:

an uneven part detecting unit operable to detect at least one uneven part that is any of a depression and a projection on an image area of the surface of the intermediate transfer member;

a reference uneven part setting unit operable to set a reference uneven part that defines the reference position from among the at least one uneven part detected by the uneven part detecting unit; and a control unit that controls the timing of forming each of the plurality of toner images based on the reference position in order to prevent positional shift of the plurality of toner images.

2. The image forming device of claim 1, wherein the reference uneven part setting unit sets the uneven part having a largest detection output among the at least one uneven part detected by the uneven part detecting unit, as the reference uneven part.

3. The image forming device of claim 2, further comprising:

a storage unit operable to store the detection output of the reference uneven part, wherein each time the uneven part detecting unit performs the detection on the surface of the intermediate transfer member, the reference uneven part setting unit resets the reference uneven part to a new uneven part having a largest detection output among at least one new uneven part newly detected by the uneven part detecting unit as a new reference uneven part, and replaces the detection output stored in the storage unit by the detection output of the new reference uneven part.

4. The image forming device of claim 1, further comprising:

a toner image forming prohibiting unit operable to prohibit forming the plurality of toner images when a total detection output of the at least one uneven part detected for one rotation of the intermediate transfer member is equal to or larger than a predetermined value.

5. The image forming device of claim 1, further comprising:

a displaying unit operable to display a message to a user, wherein the displaying unit displays a predetermined message when a total detection output of the at least one uneven part detected for one rotation of the intermediate transfer member is equal to or larger than a predetermined value.

6. The image forming device of claim 1, further comprising:

an image forming area determining unit operable to determine a suitable location of an image forming area for forming the plurality of toner images based on a result of detecting the at least one uneven part by the uneven part detecting unit.

7. The image forming device of claim 6, further comprising:

a cleaner including a cleaning member that is detachably contactable with the surface of the intermediate transfer member, operable to remove a toner from the surface of the intermediate transfer member by having the cleaning member contact the surface of the intermediate transfer member; and a cleaner control unit operable to control the cleaning member of the cleaner, wherein the cleaner control unit prohibits the cleaning member from contacting an area other than the image forming area unless a predetermined condition is satisfied.

8. The image forming device of claim 7, wherein the predetermined condition is that a detection accuracy of the uneven part detecting unit degrades, and if the predetermined condition is satisfied, the cleaner control unit has the cleaner contact the area other than the image area.

9. The image forming device of claim 6, further comprising:

a toner image forming prohibiting unit operable to prohibit forming the plurality of toner images when the image forming area includes an uneven part having a detection output that is equal to or larger than a predetermined value.

10. The image forming device of claim 9, wherein the predetermined value is changed by at least one condition out of a transfer material type, a transfer material size, and a color mode.

11. The image forming device of claim 6, further comprising:

a displaying unit operable to display a message to a user, wherein the displaying unit displays a predetermined message when the image forming area includes an uneven part having a detection output that is equal to or larger than a predetermined value.

12. The image forming device of claim 11, wherein the predetermined value is changed by at least one condition out of a transfer material type, a transfer material size, and a color mode.

13. The image forming device of claim 1, wherein the uneven part detecting unit is movable in a direction perpendicular to a running direction of the intermediate transfer member.

14. The image forming device of claim 1, wherein the uneven part detecting unit includes a reflection-type sensor.

15. The image forming device of claim 1, wherein an image control sensor functions as the uneven part detecting unit.

16. The image forming device of claim 1, further comprising:

one photoreceptor on which the plurality of toner images are formed, wherein the plurality of toner images are formed in sequence on a surface of the photoreceptor, and the formed toner images are transferred in layers onto the intermediate transfer member.

17. The image forming device of claim 1, wherein the uneven part detecting unit detects the at least one uneven part according to at least one timing out of: each time the image forming device is turned on; each time a predetermined process is performed; each time a predetermined number of image formations is made; and each time a predetermined image forming operation time has passed.

18. An image forming device for forming a color image, comprising:

an intermediate transfer member, being rotated, onto which toner images of different colors are transferred one by one based on a reference position thereon;

an uneven part detecting unit that is arranged to face the intermediate transfer member and detects at least one uneven part that is any of a depression and a projection on an image area of a surface of the intermediate transfer member;

a specifying unit operable to specify a location of the intermediate transfer member as the reference position based on a result of detecting the at least one uneven part by the uneven part detecting unit; and a control unit that controls the timing of the transfer of the toner images of different colors onto intermediate transfer member based on the reference position in order to prevent positional shift of the plurality of the toner images of different colors.

19. The image forming device of claim 18, wherein the specifying unit specifies the reference position by comparing a detection value detected by the uneven part detecting unit with a reference uneven part value that has been set in advance.

20. The image forming device of claim 19, wherein the specifying unit specifies, as the reference position, a location of the intermediate transfer member including an uneven part detected by the uneven part detecting unit and having a detection value that is identical to the reference uneven part value.

21. The image forming device of claim 20, further comprising:

a storage unit operable to store the detection value detected by the uneven part detecting unit, wherein the uneven part detecting unit includes a light volume detecting unit that has a light emitting element for emitting light to the intermediate transfer member and a light receiving element for receiving the light reflected on the surface of the intermediate transfer member, the storage unit stores a detection value for one rotation of the intermediate transfer member detected by the light volume detecting unit, and the reference uneven part value is a value indicating a largest change volume among the detection value stored in the storage unit.

22. The image forming device of claim 19, wherein the specifying unit specifies, as the reference position, a location of the intermediate transfer member including an uneven part detected by the uneven part detecting unit and having a detection value that is larger than the reference uneven part value.

23. The image forming device of claim 22, further comprising:

a storage unit operable to store the detection value detected by the uneven part detecting unit, wherein the uneven part detecting unit includes a light volume detecting unit that has a light emitting element for emitting light to the intermediate transfer member and a light receiving element for receiving the light reflected on the surface of the intermediate transfer member, and the storage unit stores a detection value for one rotation of the intermediate transfer member detected by the light volume detecting unit, and the reference uneven part value is a value between a value indicating a largest change volume and a value indicating a second largest change volume among the detection value stored in the storage unit.

24. An image forming method that transfers a plurality of toner images of different colors in layers, onto an intermediate transfer member by controlling a timing of forming each of the plurality of toner images, based on a reference position on a surface of the intermediate transfer member, the image forming method comprising the steps of:

detecting at least one uneven part that is any of a depression and a projection on an image area of the surface of the intermediate transfer member;

setting a reference uneven part that defines the reference position from among the at least one uneven part detected in the uneven part detecting step;

controlling the timing of forming each of the plurality of toner images based on the reference position in order to prevent positional shift of the plurality of toner images.

* * * * *